United States Patent [19]

Nixon

[11] 4,155,026

[45] May 15, 1979

[54] MESH ELECTRODES

[75] Inventor: Ralph D. Nixon, Braintree, England

[73] Assignee: English Electric Valve Company Limited, Chelmsford, England

[21] Appl. No.: 828,109

[22] Filed: Aug. 22, 1977

[30] Foreign Application Priority Data

Aug. 25, 1976 [GB] United Kingdom ..... 35413/76

[51] Int. Cl.[2] ..... H01J 1/46; H01J 1/52; H01J 17/12; H01J 19/40

[52] U.S. Cl. ..... 313/348; 313/259; 313/268; 313/347; 313/497; 313/517

[58] Field of Search ..... 313/348, 349, 269, 461, 313/477, 482, 497, 494, 498, 488, 517, 268, 257, 259

[56] References Cited

U.S. PATENT DOCUMENTS

| | | | |
|---|---|---|---|
| 2,909,687 | 10/1959 | Turk et al. | 313/269 X |
| 3,237,044 | 2/1966 | Mitchell | 313/348 X |
| 3,619,694 | 11/1971 | Tanji | 313/497 |
| 3,800,178 | 3/1974 | Farina | 313/497 |

*Primary Examiner*—Saxfield Chatmon, Jr.
*Attorney, Agent, or Firm*—Diller, Ramik & Wight

[57] ABSTRACT

A mesh electrode for a c.r.t. display device consists of a number of coplanar portions of mesh insulated from each other and secured to a support plate by means of a refractory compound incorporating particles larger than the pitch of the mesh. These particles space the mesh away from the support plate and allow the electrode to be easily fabricated.

10 Claims, 2 Drawing Figures

MESH ELECTRODES

This invention relates to mesh electrodes, and although of general application, it is particularly suitable for use with display tubes which are the subject of patent application Nos. 6455/76,, 28792/76 and 28793/76. In these prior applications a requirement arises to mount a segmented mesh electrode so that it can control the passage of electrons selectively through the different segments, and to enable this to be done it is necessary for the segments to be electrically insulated from each other. This requirement poses manufacturing difficulties since the segments are thin and fragile and must be accurately positioned in relation to each other, and the present invention seeks to provide a mesh electrode which can be readily produced.

According to this invention a mesh electrode having a plurality of electrically mutually insulated segments is mounted on a supporting member by means of a refractory compound which incorporates particles which are larger than the pitch of the mesh so as to hold the mesh electrode away from the supporting member.

Normally the supporting member will be a metal, in which case both the refractory compound and the particles are composed of electrically insulating materials.

The refractory compound is applied as a paste or liquid containing the solid particles, and preferably the refractory compound is a glass cement. Suitable glass cements are those marketed by the Corning Glass Works under the name Pyroceram.

Preferably, the particles are composed of refractory material, such as silicon dioxide or aluminium oxide. Alternatively, very small glass balls can be used.

Figure 1:
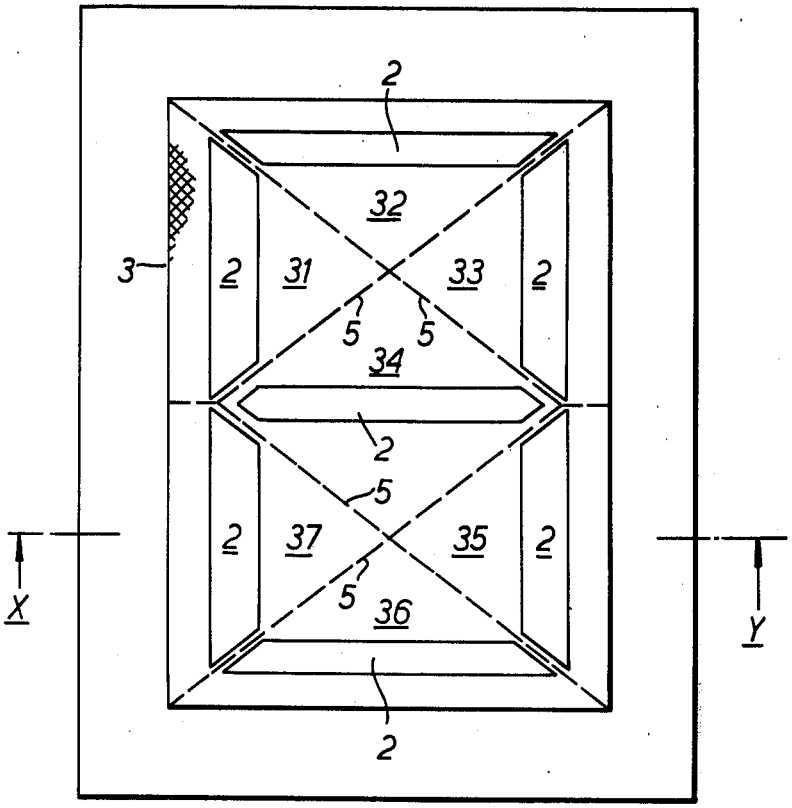
Figure 2:
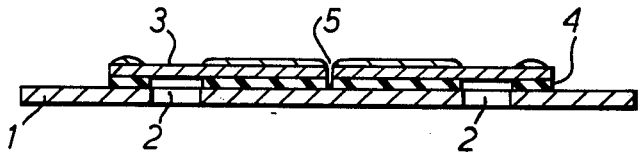

The invention is further described, by way of example, with reference to the accompanying drawings in which, FIG. 1 illustrates a mesh electrode in accordance with the present invention, and FIG. 2 illustrates a section view taken on the line X—Y.

Referring to the drawings, the mesh electrode consists of a metallic support plate 1 having seven apertures 2 arranged in a figure of eight pattern. The plate 1 supports a sheet of mesh material 3 which is attached by a thin layer of electrically insulating cement 4. The cement 4 contains particles (not separately shown) which are larger than the pitch of the mesh material 3, and so serve to space the mesh material 3 away from the plate 1. It is not necessary for all particles to be larger than the pitch of the mesh. After fixing the mesh material 3 to the plate the mesh material 3 is separated into seven electrically isolated portions 31 to 37 by producing channels 5 which extend into the layer of cement 4.

A method of making the mesh electrode is as follows.

The apertures 2 are formed in the rectangular metallic plate 1 by any convenient machining process, e.g. punching. The refractory material known as Pyroceram (Pyroceram is a trade name of Corning Glass Works) which is supplied as a fine powder is mixed in a binder of nitrocellulose dissolved in amyl acetate. Particles of a non-reactive insulating refractory material, e.g. silicon dioxide, aluminium oxide or microscopic glass balls are added to the mixture. The particles have diameters which are greater than the size of the holes in the mesh material 3, and the particles typically form about 20% of the mixture. The mixture is then thickly painted onto the plate 1 and allowed to dry. The mesh 3 is applied, and a pressure plate is positioned over the mesh whilst the mixture is fired at a temperature of about 450° C. for some hours. The binder decomposes, and the Pyroceram becomes initially glassy and then forms a ceramic material which cannot subsequently be melted. The particular Pyroceram used is selected to have a coefficient of expansion which is matched with the plate and mesh material. During the firing step the refractory particles hold the mesh away from the plate 1 so that when the Pyroceram hardens the mesh is electrically insulated. During the firing process some Pyroceram may ooze through the holes in the mesh material as shown at 6, and this serves to strengthen the bond between the mesh material 3 and the plate 1.

The individual segments 31 to 37 are then formed from the initially continuous mesh material 3 by the use of a high-speed narrow grinding wheel which cuts out the channels 5 to leave each segment insulated from the others and from the plate 1.

The use of the invention enables segmented mesh electrodes to be made which are tautly held in a plane parallel to and very close to the plane of the supporting plate.

I claim:

1. A mesh electrode having a plurality of electrically mutually insulated segments and which is mounted on a supporting member by means of a refractory compound which incorporates particles which are larger than the pitch of the mesh so as to hold the mesh electrode away from the supporting member.

2. A mesh electrode as claimed in claim 1 and wherein the supporting member is metal, and both the refractory compound and the particles are composed of electrically insulating materials.

3. A mesh electrode as claimed in claim 1 and wherein the refractory compound is a glass cement.

4. A mesh electrode as claimed in claim 1 and wherein the particles are composed of refractory material.

5. A mesh electrode as claimed in claim 4 and wherein the refractory material is silicon dioxide or aluminium oxide.

6. A mesh electrode as claimed in claim 1 and wherein the particles are very small glass balls.

7. A mesh electrode as claimed in claim 2 and wherein the refractory compound is a glass cement.

8. A mesh electrode as claimed in claim 2 and wherein the particles are composed of refractory material.

9. A mesh electrode as claimed in claim 3 and wherein the particles are composed of refractory material.

10. A mesh electrode as claimed in claim 9 and wherein the refractory material is silicon dioxide or aluminium oxide.

* * * * *